US007134394B2

(12) United States Patent
Schmid

(10) Patent No.: US 7,134,394 B2
(45) Date of Patent: Nov. 14, 2006

(54) PRINTING CYLINDER WITH CLAMPING CHANNEL AND ROTATABLE SPINDLE CLAMPING MECHANISM

(75) Inventor: Georg Schmid, Neusäss (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/062,653

(22) Filed: Feb. 22, 2005

(65) Prior Publication Data

US 2005/0193910 A1 Sep. 8, 2005

(30) Foreign Application Priority Data

Feb. 23, 2004 (DE) ..... 10 2004 008 723

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS 2,051,858 A * 8/1936 Huck et al. ..... 101/415.1
2,621,592 A * 12/1952 Faeber ..... 101/415.1
2,946,282 A * 7/1960 Harless ..... 101/415.1
4,068,586 A * 1/1978 Frey et al. ..... 101/415.1
5,749,299 A * 5/1998 Barrois et al. ..... 101/483
2005/0139107 A1* 6/2005 Heller et al. ..... 101/415.1

FOREIGN PATENT DOCUMENTS

DE 641173 * 1/1937
DE 26 33 445 A1 1/1978
EP 0 686 504 A2 12/1995
WO WO 03/072359 A2 * 9/2003

OTHER PUBLICATIONS

Search report in counterpart European Patent Application No. 05003618.5 (Apr. 28, 2005).

* cited by examiner

*Primary Examiner*—Leslie J. Evanisko
(74) *Attorney, Agent, or Firm*—Leydig, Voit & Mayer, Ltd.

(57) ABSTRACT

The printing cylinder such as a rubber blanket cylinder of a web fed offset printing machine is provided. The printing cylinder includes a rotatable clamping mechanism in a clamping channel. A side of the clamping channel is configured so as to be movable such that the clamping channel can be opened by turning the clamping mechanism. When the clamping channel is open, the ends of the rubber blanket can be inserted. The clamping channel can then be closed by turning the clamping mechanism in the opposite direction such that the ends of the rubber blanket adjoin one another.

3 Claims, 3 Drawing Sheets

PRINTING CYLINDER WITH CLAMPING CHANNEL AND ROTATABLE SPINDLE CLAMPING MECHANISM

FIELD OF THE INVENTION

The invention pertains to a printing cylinder, particularly a rubber blanket cylinder of a web fed offset printing machine with a channel that extends in the axial direction and in which the ends of an offset blanket (rubber blanket) to be clamped onto the cylinder can be fixed by means of a clamping mechanism arranged inside the clamping channel.

BACKGROUND OF THE INVENTION

In most printing machines, it is still a common practice to utilize printing cylinders having a clamping channel that extends in the axial direction of the cylinder and in which the printing plate or, in the case of offset printing machines, the offset blanket, to be clamped onto the printing cylinder is fixed. When rolling over the cylinder channels, the printing cylinders installed together are disengaged such that vibrations are generated. Among other things, these vibrations have a negative impact on the printing quality as well as on the maximum printing speed of such a printing machine. Consequently, attempts have been made for quite some time to provide arrangements in which only one of the printing cylinders used in an offset printing machine has a channel, in order to minimize the vibrations stimulated by changes in the line force during the channel roll over. For example, only plate cylinders (also referred to as form cylinders) were provided with a clamping channel, while rubber blanket cylinders (also referred to as transfer cylinders) were equipped with so called sleeves that could be slipped on axially. This made it possible to reduce the cylinder vibrations and, among other things, to increase the rotational speeds of the printing units or printing machines, while still achieving an adequate print quality. However, utilizing such sleeves is more costly because the manufacturing cost of these sleeves is much higher than that of conventional rubber blankets.

Another alternative for reducing the vibrations stimulated by changes in the line force consists of fixing finite rubber blankets on metal plates and inserting only the ends of the metal plates into the channels of the rubber blanket cylinders. As compared to the cylinder channels of a conventional rubber blanket clamping mechanism, this arrangement enables the width of the cylinder channels to be significantly reduced. Although these measures also lead to a reduction in vibration, the utilization of rubber blankets with a metal backing significantly increases the cost as compared to conventional rubber blankets.

BRIEF SUMMARY OF THE INVENTION

In view of the foregoing, a general object of the present invention is providing an improved printing cylinder, particularly a rubber blanket cylinder of a web fed offset printing machine suitable for use with conventional rubber blankets, with which the vibrations stimulated by changes in the line force can be minimized in comparison with prior art cylinder constructions.

DETAILED DESCRIPTION OF THE INVENTION

Preferred embodiments of the invention are illustrated in FIGS. 1–4. An important aspect of the present invention comprises configuring at least one side of the clamping channel 2 of a printing cylinder (in the case of the illustrated embodiment, a rubber blanket cylinder of a web fed offset printing machine) such that it is circumferentially movable. This mobility enables the clamping channels 2 to be opened and closed by adjusting (in this case, by turning) the clamping mechanisms 3. In particular, the clamping mechanisms can be adjusted in such a way that the ends of the rubber blankets clamped onto the printing cylinders 1 of FIGS. 1–4 can be fixed and the clamping channels can be closed by moving at least one side of the clamping channels 2. Consequently, the effective width of the clamping channel is significantly reduced in comparison with conventional printing cylinders during the printing operation, and the vibrations stimulated by line force changes are accordingly minimized.

Figure 1:
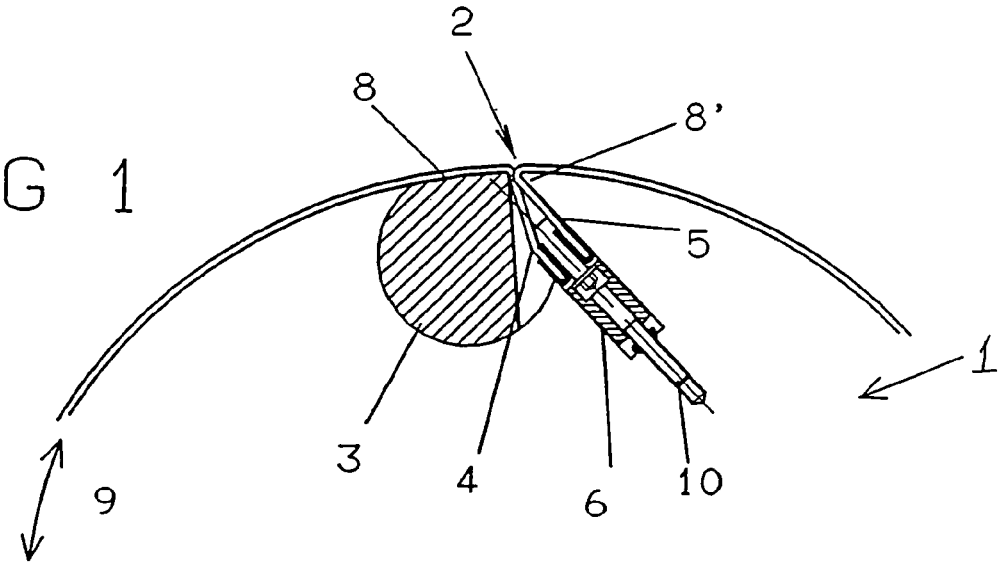
FIG. 1 is a schematic, partial side sectional view of an illustrative rubber blanket cylinder according to the present invention with the clamping channel closed.
Figure 2:
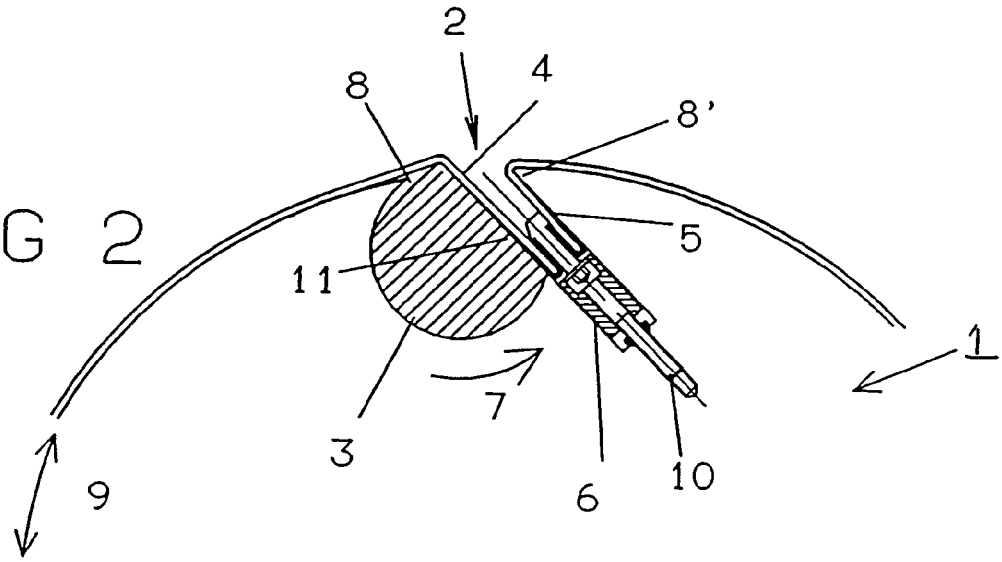
FIG. 2 is a schematic, partial side sectional view of the rubber blanket cylinder of FIG. 1 with the clamping channel open.

The printing cylinder shown in FIG. 1 consists of a rubber blanket cylinder, with the rubber blanket cylinder shown in a "closed state," as described in greater detail below. On its circumference, the printing cylinder 1 has a clamping channel 2 that extends in the axial direction of the cylinder and in which a clamping mechanism 3 is arranged. Although the scope of the present invention, in principle, allows various clamping mechanisms to be utilized, it is advantageous to configure the clamping mechanism 3 so as to have a circular cross section (i.e., it is practical to utilize a clamping spindle 3 that may be arranged in an axially extending bore of the printing cylinder 1). The shape and design of the clamping spindle 3 shown in FIGS. 1 and 2 enable the ends 4, 5 of the rubber blanket arranged on the printing cylinder 1 to be inserted at certain angular positions of the clamping spindle 3, as indicated in FIG. 2. The clamping channel 2 can then be closed by turning the clamping spindle 3 in the clockwise direction, namely such that the clamping channel shown in FIG. 1 reaches its closed state, in which the ends 4, 5 of the rubber blanket practically adjoin one another. The advantage of the closed state shown in FIG. 1 is that the effective width of the channel is much smaller than that of conventional clamping channels. With this arrangement, a substantial reduction or nearly complete elimination of the vibrations stimulated by changes in the line force can be achieved. Moreover, it is also advantageous that no objects or materials (e.g., auxiliary pressure mediums) can be admitted.

According to one preferred embodiment, shown in FIGS. 1 and 2, the clamping spindle 3 has the same curvature radius or the same circumferential contour as the printing cylinder over a section of its circumferential surface. Accordingly, that region of the clamping spindle 3 forms the movable side 8 of the clamping channel 2 when the clamping spindle 3 is turned. In this case, the other side 8' of the clamping channel remains stationary. The circumferential surface of the clamping spindle 3 may also have a smaller curvature radius such that the bore in the printing cylinder 1 for accommodating the clamping spindle 3 can have a correspondingly smaller configuration.

The ends 4, 5 of the illustrated conventional rubber blanket can be reinforced such that they can be fixed in a P-shaped holding part in the form of a holding rail 6 when the holding rail 6 is transversely inserted into the cylinder. The holding rail 6 may be held in the clamping channel 2 with the aid of holding elements, for example, screws 10.

The cylinder channel 2 shown in FIG. 1 can be open and closed by turning the clamping spindle 3 in one of the directions indicated by the arrow 9. When closed, in this case, the outer section adjoins the cylindrical contour of the printing cylinder without forming a joint. According to FIG. 2, the clamping channel is opened by turning the clamping spindle 3 in the direction of the arrow 7. In this case, the end 4 of the rubber blanket adjoins the surface 11 of the clamping spindle 3 while the movable side 8 of the clamping channel moves into the left position, as shown in FIG. 2, in order to receive or release, respectively, the ends 4, 5 of the rubber blanket.

Figure 3:
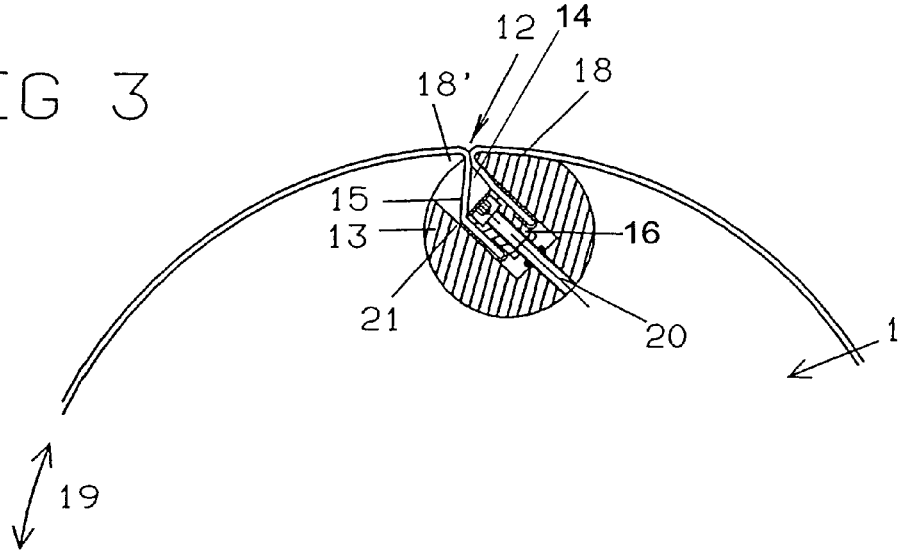
FIG. 3 is a schematic, partial side sectional view of an alternative embodiment of a rubber blanket cylinder according to the present invention with the clamping channel closed.
Figure 4:
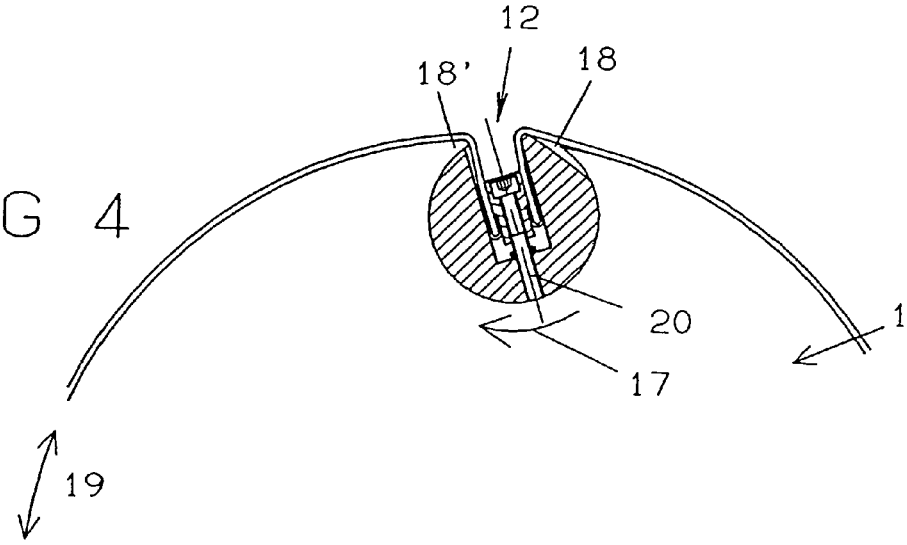
FIG. 4 is a schematic, partial side sectional view of the rubber blanket cylinder of FIG. 3 with the clamping channel open.

A further embodiment that also utilizes a clamping spindle 13 arranged in the clamping channel 12 is illustrated in FIGS. 3 and 4. In contrast to the embodiment of FIGS. 1 and 2, the embodiment of FIGS. 3 and 4 includes a clamping spindle 13 that is practically designed in the form of a solid cylinder with an axially extending clamping slot 21, into which the ends 14, 15 of the rubber blanket can be inserted and fixed. In this respect, elements similar to those described above with reference to the embodiment of FIGS. 1 and 2 can be utilized, namely a holding rail 16 and a screw 20 for fixing the holding rail.

When the clamping spindle 13 is turned in the direction of the arrow 17, the clamping channel 12 is moved from a closed position (shown in FIG. 3) into an open position. In the closed position of FIG. 3, the circumferential section of the clamping spindle 13 forms the movable side 18' of the clamping channel, while, in this case, the other side 18 is stationary due to the design of the printing cylinder 1. In the embodiment of FIGS. 3 and 4, the circumference of the clamping spindle 13 that forms the movable side of the clamping channel 12 also has a curvature that approximately corresponds to the radius or to the circumferential contour of the printing cylinder 1. Thus, a continuous rolling motion of the concerned cylinders is achieved. The rubber blanket can be clamped onto and removed from the printing cylinder in the embodiment, according to FIGS. 3 and 4, by turning the clamping spindle 13 in one or the other direction (see arrow 19). Accordingly, the previously described advantages are also attained in the closed position of this embodiment.

Those skilled in the art will understand that the clamping channels and the clamping elements of the present invention could be designed differently than what is shown in the figures. Consequently, the scope of the invention is not limited to the preferred embodiments shown in FIGS. 1–4. For example, if required, the other side of the clamping channel, i.e., the other side, also could be configured so as to be movable in analogous manner.

Figure 5:
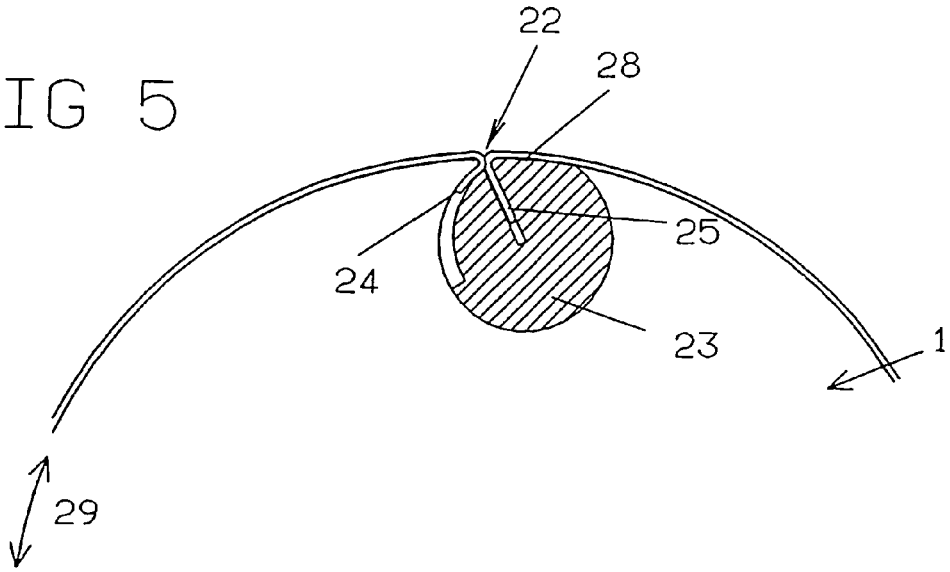
FIG. 5 is a schematic, partial side sectional view of another embodiment of a rubber blanket cylinder according to the present invention with the clamping channel closed.
Figure 6:
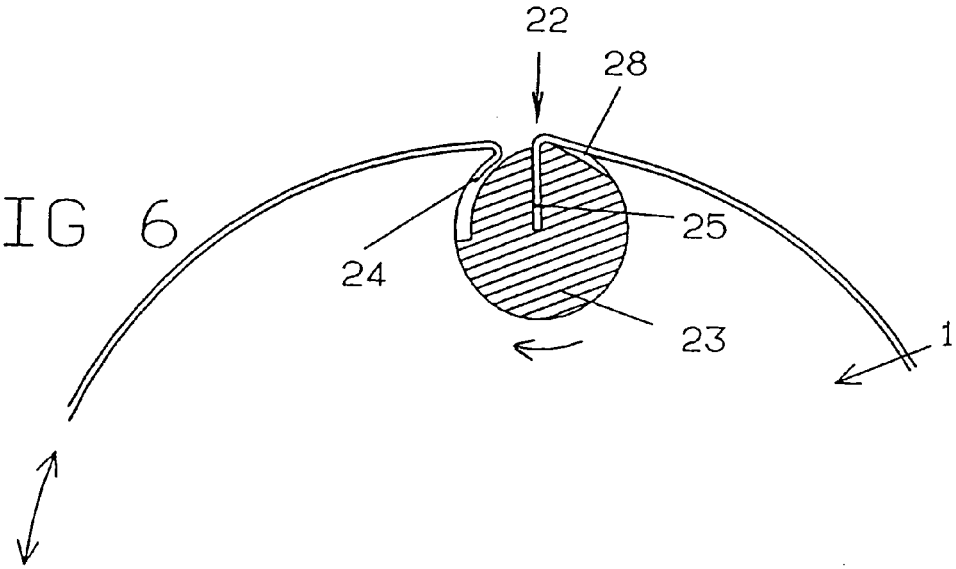
FIG. 6 is a schematic, partial side sectional view of another embodiment of a rubber blanket cylinder according to the present invention with the clamping channel open.

Another novel and independently inventive embodiment of the clamping channel is shown in FIGS. 5 and 6. The clamping channel of this embodiment comprises a pit 22 in the printing cylinder 1 with a clamping spindle 23 that has flattening 28 with a curvature that corresponds to that of the cylinder 1, as well as a slot 25 for receiving the rubber blanket end. The other end 24 of the rubber blanket can be inserted into the recess of the spindle 23 such that the rubber blanket can be clamped onto the printing cylinder as shown in FIG. 5, as well as released and removed therefrom as shown in FIG. 6, by turning the clamping spindle 23 in the appropriate direction.

What is claimed is:

1. A printing cylinder to which an offset blanket can be clamped comprising a cylinder body, a clamping channel that extends in the axial direction of the cylinder body;

a clamping mechanism arranged in parallel relation to said clamping channel for fixing ends of the offset blanket in the clamping channel;

the clamping channel being defined by a plurality of sides defining a space into which the rubber blanket ends can be inserted into the clamping channel, said clamping mechanism including a rotatable, substantially cylindrical spindle having a diameter less than the diameter of said cylinder body, said cylinder body being formed with a substantially cylindrical spindle receiving chamber parallel to said clamping channel that supports said spindle for relative rotational movement, said spindle substantially occupying said spindle receiving chamber, said spindle defining at least one side of the said clamping channel that is moveable in a circumferential direction relative to a circumferential surface of the cylinder body as an incident to a closed blanket retaining position to rotation of the spindle to completely close the clamping channel with only the ends of the rubber blanket retained therein, and said spindle having a peripheral portion adjacent said one side that has a curvature radius substantially the same as the curvature radius of said printing cylinder such that when said spindle is in said closed blanket retaining position the outer circumferential surface of said cylinder body is substantially uninterrupted for vibration free operation of the printing cylinder; and wherein the clamping mechanism is provided with a longitudinal slot for receiving the ends of the rubber blanket.

2. The printing cylinder according to claim 1, wherein the clamping mechanism movable side is moved in the circumferential direction when the clamping mechanism is rotated in the clamping channel so as to change the clamping channel between open and closed states.

3. A printing cylinder to which an offset blanket can be clamped comprising:

a cylinder body, a clamping channel that extends in the axial direction of the cylinder body;

a clamping mechanism arranged in parallel relation to said clamping channel for fixing ends of the offset blanket in the clamping channel;

the clamping channel being defined by a plurality of sides defining a space into into which the rubber blanket ends can be inserted into the clamping channel, said clamping mechanism including a rotatable, substantially cylindrical spindle having a diameter less than the diameter of said cylinder body, said cylinder body being formed with a substantially cylindrical spindle receiving chamber parallel to said clamping channel that supports said spindle for relative rotational movement, said spindle substantially occupying said spindle receiving chamber, said spindle defining at least one side of the said clamping channel that is moveable in a circumferential direction relative to a circumferential surface of the cylinder body as an incident to rotation of the spindle to a closed blanket retaining position to completely close the clamping channel with only the ends of the rubber blanket retained therein, said spindle having a peripheral portion adjacent said one side that has a curvature radius substantially the same as the curvature radius of said printing cylinder such that when said spindle is in said closed blanket retaining position, the outer circumferential surface of said cylinder body is substantially uninterrupted for vibration free operation of the printing cylinder, and said spindle substantially occupies said cylindrical spindle receiving chamber without any portion of the spindle extending outwardly beyond the radius of the cylindrical spindle receiving chamber.

* * * * *